United States Patent [19]

Snyder, Jr. et al.

[11] Patent Number: 4,569,609

[45] Date of Patent: Feb. 11, 1986

[54] PRINT RIBBON COMPRISING A FRICTIONAL BACK LAYER

[75] Inventors: Donald E. Snyder, Jr., Brockport; Donald J. Watters, Fairport, both of N.Y.; Frank M. Palermiti, Sarasota, Fla.

[73] Assignee: Burroughs Corporation, Detroit, Mich.

[21] Appl. No.: 630,834

[22] Filed: Jul. 13, 1984

[51] Int. Cl.[4] ..... B41J 31/05; B41J 31/06

[52] U.S. Cl. ..... 400/241.4; 400/241.1; 400/702; 400/241

[58] Field of Search ..... 400/241, 241.1, 241.2, 400/241.3, 241.4, 701, 702

[56] References Cited

U.S. PATENT DOCUMENTS

| | | | |
|---|---|---|---|
| 893,815 | 8/1908 | Clarke | 400/241 |
| 2.980,941 | 4/1961 | Miller | 400/241.2 |
| 3,080,954 | 3/1963 | Newman | 400/241.4 |
| 3,092,236 | 6/1963 | Campbell | 400/241.4 |
| 3,330,791 | 7/1967 | Mater | 400/241.2 |
| 3,348,651 | 10/1967 | Mater | 400/241.4 |
| 3,872,961 | 3/1975 | St. James | 400/702 |
| 4,321,286 | 3/1982 | Scott | 400/241.2 |
| 4,477,198 | 10/1984 | Bowlds | 400/241.1 |

FOREIGN PATENT DOCUMENTS

| | | | |
|---|---|---|---|
| 1028618 | 5/1966 | United Kingdom | 400/241.1 |

OTHER PUBLICATIONS

Findlay, Ribbon Film Coating, Jul. 1972, vol. 15, No. 2, p. 368.

Findlay, Ink to Paper Lubricant, Jun. 1983, vol. 16, No. 1, p. 298.

Klueh, Ribbon with Modified Polyethylene Terephthalate Substrate, Jun. 1984, vol. 27, No. 1B, p. 639.

Dueltgen, Reduction of Friction of Thermal Printing, Nov. 1984, vol. 27, No. 6, p. 3295.

*Primary Examiner*—Edgar S. Burr

*Assistant Examiner*—William L. Klima

[57] ABSTRACT

A multi-strike (typewriter) ribbon comprising a web of synthetic resinous material having top and bottom surfaces with an ink coating on the top surface of the web and a back layer on the bottom surface of the web, the back layer providing a clean, frictional surface which provides good contact with the drive apparatus which drives the printing ribbon as it performs a printing function.

15 Claims, 1 Drawing Figure

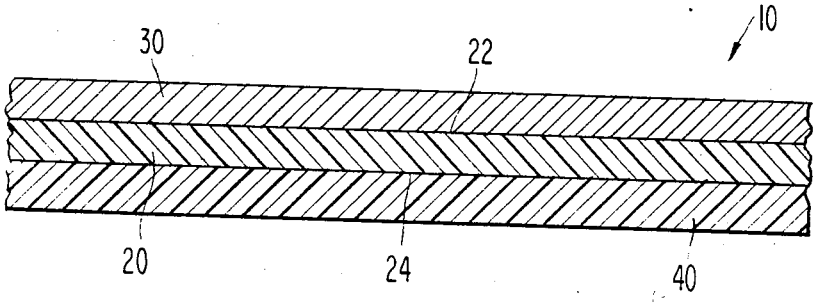
10
30
22
20
24
40

PRINT RIBBON COMPRISING A FRICTIONAL BACK LAYER

BACKGROUND OF THE INVENTION

Ribbons of the type used in typewriters and similar print mechanisms comprise a web of synthetic resinous material coated with an ink coating which contains, among other things, oil and the material deposited on paper during the printing process. Such print ribbons, especially those of narrow width, may present problems in being driven by the printer mechanism. For example, if oil is exuded from a ribbon onto the feed mechanism, when the ribbon is fed, the presence of the oil can cause hang-up of the film and drag of the film so that the ribbon will not pull through the feed mechanism. In addition, if oil is present on the drive gear, it can have a lubricating effect and cause slippage of the ribbon so that the ribbon will not advance.

In another problem situation, oil can build up on the drive gear to such a thickness that the ribbon will bind on the drive gear. Also, as the ribbon is wound up, the front surface comes into contact with the rear surface, and the presence of oil on the rear surface can adversely affect winding and the ribbon may slip. These problems may be magnified by heat.

The present invention substantially eliminates these problems in a novel typewriter ribbon which, among other things, includes a back coating of such a nature that it alters the friction characteristics of the ribbon and adsorbs oil.

DESCRIPTION OF THE DRAWING

The drawing is a sectional view of a portion of a printing ribbon embodying the invention.

DESCRIPTION OF THE INVENTION

A typical print ribbon 10 includes a web 20 of synthetic resinous material, such as Mylar, having a top surface 22 and a bottom surface 24. The top surface is coated with an ink layer 30 of printing material including one or more oils, a pigment and/or dyes, and other materials as binders or vehicles.

According to the invention, a protective or barrier layer 40 is provided on the rear surface of the web 20. This layer 40 serves to maintain a clean, high-friction surface which comes into contact with the drive mechanisms of the printing apparatus. The layer 40 seems to operate by adsorbing oil which may come out of the ink layer.

There is no particular chemical relationship between the rear protective layer 40 and the other two layers of the ribbon. As noted, the primary characteristics of the layer 40 are that it adsorbs oil and increases the frictional characteristics of the ribbon with respect to the apparatus which drives the ribbon, and the constituents are selected for their ability to provide these functions. One successful layer 40 includes resins and a silica-bearing filler, and, in one case, two resins were used including Estane, which is a polyurethane resin, and VROH resin, which is a terpolymer of vinyl chloride, vinyl acetate and a hydroxyl molecule containing alkyl acrylate, and the filler was Syloid, which is a silica-bearing filler. Estane is made by B. F. Goodrich, and VROH is made by Union Carbide. Other polyester and vinyl chloride resins may be used.

In the composition of the back coat, the resins may be provided in substantially equal portions, for example, about 3% to about 15%, with the filler being present in a small proportion of about 1% to 2%. The resins are dissolved in a suitable solvent such as methyl ethyl ketone, with the amount of solvent provided being determined by the method of applying the formulation to the synthetic resinous material.

The following illustrate back coat compositions using two different resin systems:

| Material | Percent |
|---|---|
| I | |
| Methyl Ethyl Ketone | 94 |
| Polyurethane (Estane 5702) | 1.5–4.5 |
| Vinyl Chloride Resin (VROH) | 1.5–4.5 |
| Syloid 308 | 1–2 |
| | 100.0 |
| II | |
| Methyl Ethyl Ketone | 90 |
| Polyurethane (Estane 5702) | 2.5–7.5 |
| Vinyl Chloride Resin (VROH) | 2.5–7.5 |
| Syloid 308 | 1–2 |
| | 100.0 |

The back coat solution, for coating on a ribbon, may be prepared in any suitable manner, for example, by slowly mixing the individual constituents with the solvent until the desired solution is achieved. Similarly, the back coat formulation may be applied to a ribbon in any suitable manner and with any suitable apparatus, for example, by means of gravure printer, reverse roll coater, wire rod coater, or the like.

In a modification of the invention, multi-strike ribbons, or any ribbons, are modified to make them wind up relatively trouble free in ribbon cartridges. This is achieved, in addition to the above-described application of a back coat 40 to the web 20, by the incorporation into the ink coating 30 of an oil-adsorbing material such as a diatomaceous earth and/or silica-type material. When these two methods are combined in one ribbon, this is additional insurance that the ribbon will perform well in the printing apparatus.

A typical ink layer may include polyvinyl chloride, a resin, a diatomaceous earth, and a grind which is a mixture of non-volatile oils and colorants.

Some other fillers which may be used include Dicalite WB5 made by Grefco Inc., Aerosil made by Degussa Corp., and Zeeospheres made by Zeelan Industries.

What is claimed is:

1. A printing ribbon comprising a web of synthetic resinous material having top and bottom surfaces;

a printing coating of ink-bearing material on said top surface of said web; and a back layer on said bottom surface of said web;

said back layer including filler material which produces a rough, frictional outer surface which (1) provides frictional engagement with the drive apparatus for the ribbon and (2) can adsorb oil which might be exuded from said printing coating.

2. A printing ribbon comprising a web of synthetic resinous material having top and bottom surfaces;

a printing coating of ink-bearing material on said top surface of said web; and a back layer on said bottom surface of said web;

said back layer comprising a resin in which is dispersed a filler material which produces a rough, frictional outer surface which (1) provides frictional engagement of the back layer with the drive apparatus for the ribbon and (2) can adsorb oil which might be exuded from said printing coating.

3. A printing ribbon comprising a web of synthetic resinous material having top and bottom surfaces;

a printing coating of ink-bearing material on said top surface of said web; and a back layer on said bottom surface of said web;

said back layer providing a clean, frictional surface which provides good contact with drive apparatus which drives the printing ribbon as it performs a printing function;

said back layer including one or more resins and a silica-bearing filler.

4. The ribbon defined in claim 3 wherein said back layer includes one or more substances which can adsorb oil that may enter said back layer from said printing coating.

5. The ribbon defined in claim 3 wherein said back layer includes a resin.

6. The ribbon defined in claim 3 wherein said back layer includes a polyester or vinyl chloride resin.

7. The ribbon defined in claim 3 wherein said back layer includes a polyurethane resin.

8. The ribbon defined in claim 3 wherein said back layer includes a resin which comprises a terpolymer of vinyl chloride.

9. The ribbon defined in claim 3 wherein said back layer is prepared from a mixture including resin materials dissolved in methyl ethyl ketone and including a silica-bearing filler.

10. The ribbon defined in claim 9 wherein said resin material includes a polyurethane resin and a vinyl chloride resin.

11. The ribbon defined in claim 9 wherein said resin material includes a polyurethane resin and a vinyl chloride resin in substantially equal percentages.

12. The ribbon defined in claim 9 wherein said resin material includes a polyurethane resin and a vinyl chloride resin in substantially equal percentages in the range of about 3% to about 15%.

13. The ribbon defined in claim 3 wherein said printing layer includes an oil-adsorbing material.

14. The ribbon defined in claim 13 wherein said oil-adsorbing material is a diatomaceous earth.

15. The ribbon defined in claim 13 wherein said oil-adsorbing material is a silica-type material.

* * * * *